US006539173B2

(12) United States Patent
Chu

(10) Patent No.: US 6,539,173 B2
(45) Date of Patent: Mar. 25, 2003

(54) SENSOR CONTROLLED WATER HEATER AND METHOD OF USE

(75) Inventor: Yong S. Chu, Glendale, CA (US)

(73) Assignee: Dynamo Aviation, Inc., Van Nuys, CA (US)

( * ) Notice: Subject to any disclaimer, the term of this patent is extended or adjusted under 35 U.S.C. 154(b) by 0 days.

(21) Appl. No.: 09/848,382

(22) Filed: May 2, 2001

(65) Prior Publication Data

US 2003/0021597 A1 Jan. 30, 2003

(51) Int. Cl.[7] ..... H05B 3/78
(52) U.S. Cl. ..... 392/486; 392/450; 392/490
(58) Field of Search ..... 392/486, 485, 392/490, 465, 466, 498

(56) References Cited

U.S. PATENT DOCUMENTS

| | | | | |
|---|---|---|---|---|
| 3,952,182 A | | 4/1976 | Flanders | |
| 4,410,791 A | | 10/1983 | Eastop | |
| 4,567,350 A | * | 1/1986 | Todd, Jr. | 219/213 |
| 4,786,782 A | | 11/1988 | Takai et al. | |
| 4,949,627 A | * | 8/1990 | Nordskog | 99/281 |
| 5,129,034 A | | 7/1992 | Sydenstricker | |
| 5,388,179 A | | 2/1995 | Boyd, Jr. et al. | |
| 5,479,558 A | | 12/1995 | White, Jr. et al. | |
| 5,949,594 A | | 9/1999 | Iglseder et al. | |
| 5,949,960 A | | 9/1999 | Hall | |
| 6,069,998 A | | 5/2000 | Barnes et al. | |
| 6,080,973 A | | 6/2000 | Thweatt, Jr. | |
| 6,175,689 B1 | | 1/2001 | Blanco, Jr. | |
| 6,178,827 B1 | * | 1/2001 | Feller | 73/861.22 |
| 6,240,250 B1 | * | 5/2001 | Blanco, Jr. | 392/474 |

* cited by examiner

*Primary Examiner*—Teresa Walberg
*Assistant Examiner*—Thor Campbell
(74) *Attorney, Agent, or Firm*—Gene Scott; Patent Law & Venture Group

(57) ABSTRACT

A water heater apparatus for aircraft applications has three water heating tubes joined in series interconnection and positioned in side-by-side adjacency, where each of the tubes provides an electrical resistance heater part of a 3 phase electrical power circuit. Each tube also has a thermostat, and an electrical circuit breaker. The thermostats establish an open electrical circuit if water temperature exceeds a temperature set point. The circuit breakers establish an open circuit if electric current flow exceeds an electrical current set point. The apparatus uses a pressure check valve to expel pressure from the water heating tubes when pressure exceeds a water pressure set point. A temperature sensor is positioned for sensing water temperature at a water outlet and an ultrasonic water flow sensing switch identifies water flow in the water heating tubes.

1 Claim, 1 Drawing Sheet

SENSOR CONTROLLED WATER HEATER AND METHOD OF USE

BACKGROUND OF THE INVENTION

1. Field of the Invention

This invention relates generally to water heaters and more particularly to a compact water heater for very high heating capacity for delivering water at 120–130 degrees F. at flow rates in the range of from 0.5 to 2.0 gallons per minute where heating time is not longer than about 30 seconds.

2. Description of the Related Art

The following art defines the present state of this field:

Flanders, U.S. Pat. No. 3,952,182 describes a miniature electric fluid immersion heater adapted for instantaneously heating relatively small bodies or flow increments of fluid to a predetermined temperature. The heater is particularly adaptable to be mounted immediately in advance of a hot water faucet in a home or building so as to provide a continuous flow of instantaneously heated water and thereby eliminate the standard hot water heater and the entire hot water piping system in the building. The heater comprises a small, cylindrical, thermally insulated pressure vessel having a fluid inlet and outlet as opposite ends. A series of individually actuated electrical heating elements are positioned within the vessel so as to be in intimate physical contact with the flowing fluid. The heating elements are constructed of a heavy gauge resistance element which is thinly coated with a glass or ceramic frit fused into an impervious, chemically resistant, electrically non-conductive coating having negligible thermal insulation and heat storage capabilities. The wire and coating preferably have matched thermal expansion characteristics so as to minimize stress on the coating. A control circuit for selectively activating the individual heating elements delivers electrical energy automatically responsive to demand. A flow sensor prevents the activation of the majority of the heating elements unless there is a flow of fluid through the heater. When a flow is present, the amount of electrical energy transferred to the fluid as it flows through the heater is controlled by automatic separate activation of the respective elements within the heater, the number of activated elements and their periods of activation being just sufficient to maintain a predetermined fluid temperature at the heater outlet.

Eastep, U.S. Pat. No. 4,410,791 describes an electric instant water heater mounted in a cold water line in proximity to a water tap including an elongated core molded from a ceramic material and having a rectangular cross-section water flow passage extending therethrough from a circular inlet connected to a water supply pipe to a circular outlet connected to the water tap. A plurality of parallel, spaced, thin rectangular electrical resistance heating plates are positioned within the passage with one rolled edge of each plate being embedded in the core on one side of the passage way and the opposite rolled edge of each plate extending freely into the passage. A plurality of projections molded integrally with the core extend from the opposite side of the passage into the spaces between the heating plates and terminate short of the one side of the passage to define with the plates a serpentine flow path from the inlet to the outlet to cause water to be heated to flow across each face of the heating plates. The core is thermally insulated and a thermal overheat switch is provided to control energization of the heater plates.

Todd, Jr., U.S. Pat. No. 4,567,350 describes a compact instantaneous-type electric water heater for household and commercial use providing hot water at a rate of at least five gallons per minute and including a plurality of individual heating chambers connected in series flow relationship between a cold water inlet and a hot water outlet. A metallic mixing coil is disposed in series between each adjacent pair of chambers to promote even heating. The chambers are provided with electric heating elements having a combined wattage of at least thirty-thousand (30,000) watts. The heating elements are energized by a flow switch only at the time hot water is demanded and are controlled by an adjustable thermostat which sets the outlet water temperature and by a high temperature safety switch limiting outlet water temperature should the thermostat fail. The heating elements are connected to the electrical utility system by contactor-type relays so that some of the heating elements are connected to the service side of the utility system while the others are connected to the building side of the system. An adjustable regulator is provided to assure that the water flow rate will not exceed the capacity of the heater to heat the water to a minimum acceptable level. The heater is enclosed in a sheet metal casing capable of being accomodated inside a standard wood wall between a pair of adjacent studs thereof.

Takai, et al, U.S. Pat. No. 4,786,782 describes an instantaneous water heater with enhanced temperature control and less variation in output water temperature having an output hot water pipe extending into a heating tank through the top thereof and surrounding a coiled sheath electric heater for heating the water in the tank, the output pipe extending to the tank bottom and provided with an inlet thereat. An inlet pipe for water to be heated extends into the bottom of the tank and is throttled to provide an accelerated flow of incoming water away from the heater and outlet pipe toward an overheat prevention thermostat mounted externally on the top of the tank and connected to the heater. An output hot water temperature sensor located within the output water pipe adjacent the inlet thereof cooperates with a control unit of regulating operation of the heater to maintain the hot water output temperature at a preset level. The inlet to the water output pipe is throttled to insure mixing of the heated water, accurate temperature measurement and the reduction of scale deposition on the temperature sensor.

Sydenstricker, U.S. Pat. No. 5,129,034 describes an on-demand electric water heater including at least one heating chamber having an electric heating element operatively positioned between a cold water inlet and a hot water outlet. The heating elements are controlled by pressure sensing switches activated by water flow initiation or termination. A pressure relief valve is provided as a safety feature in the event the pressure sensing switches fail.

Boyd, Jr. et al, U.S. Pat. No. 5,388,179 describes a device for protecting a heating element in an electric water heater which consists of a sensor for sensing a predetermined amount of water that has entered the electric water heater and an electric circuit with a relay controlled by the sensor, for energizing the heating element when the predetermined amount of water is within the electric water heater and covering the heating element thereby preventing the burn out of the heating element; wherein the sensor has a float with electrical contacts that engage adjustable contacts set at a desired level to energize the heating element at a predetermined water level and includes an expandable seal mounted on the float preventing water from going above the float.

White, Jr. et al, U.S. Pat. No. 5,479,558 describes a very compact tankless water heater which delivers heat in proportion to demand. A flow responsive valve energizing an electrical control system is purely flow responsive, even to minute flow, and consumes no power when dormant. An uncomplicated electronic control system is connected to power by the flow switch, and is substantially deenergized when dormant. Most electronic components of the control system are mounted on the flat front wall of the pressure vessel. Thus, overall dimensions are minimized, cool water serves as a heat sink, and heat generated by electronic controls is captured for heating purposes. In particular, triacs controlling the heating elements are cooled, thus prolonging their life. A preferred embodiment of the novel heater has a maximum electrical consumption of 22 kilowatts, with equivalent heat output, and has overall external dimensions of 24 inches in height, 5.5 inches in width, and 4 inches in depth (61 cm in height, 14 cm in width, and 10 cm in depth). An outlet pipe fitting extending above adds approximately 2 inches (5 cm) to the overall height, enabling the water heater to be installed in a typical building interior wall or partition.

Hall, U.S. Pat. No. 5,949,960 describes multiple resistance type electric heating elements projecting into the interior of the storage tank portion of an electric water heater which are protected against dry firing damage by using a water soluble member, representatively a sugar cube, positioned in the empty tank and blocking the spring-driven movement of a switch closure member that maintains an electrical circuit in an open state preventing electrical current flow through any of the heating elements. When the tank is initially filled with water the sugar cube dissolves, thereby unblocking the switch closure member and permitting it to be springdriven into a circuit closing position to permit electrical current flow through the heating elements.

Barnes, et al, U.S. Pat. No. 6,069,998 describes a screw-plug type water heater having a heating element immersible in a water heater tank to heat water. Electrical terminals on the outer end of the heater connect the heating element into a heater circuit for a control unit. The control unit also includes a sensing circuit for the unit to be responsive to water temperature inputs to turn-on the heater to heat water to a desired temperature and maintain it there. A thermistor provides a temperature input to the control circuit. The thermistor is encapsulated in a bracket mounted in, or integrally formed with, the screwplug to sense water temperature. Terminals on the outer end of the heater allow the thermistor to be connected into the control circuit.

Thweatt, jr., U.S. Pat. No. 6,080,973 describes an electric water heater which includes a polymeric body having an elongated hollow and an inlet opening and an outlet opening in communication with the hollow for flowing water to pass therethrough. An electrical resistance heater having a heating element of a material exhibiting a positive temperature coefficient of resistance is disposed in the hollow of the polymeric body and in heat transfer communication with water flowing through the hollow. An electrical source supplies electrical power to the heating element to generate heat. A controller senses current flow through the heating element and determines a resistance related value, such as current or resistance of the heating element. The controller also determines a first derivative of the resistance related value over time, and determines a second derivative of the resistance related value over time, and controls power supply to the heating element as a function of the first and second derivatives and/or absolute resistance.

Blanco, jr. U.S. Pat. No. 6,175,689 describes an improved "in-line" tankless electrical resistance water heater including a top having a cold water inlet and a hot water outlet for connection to the cold, and hot water lines of a faucet in a sink. The water heater includes a body with a passageway through which cold water travels, from the top towards the bottom, where it is fed into two separate chambers on opposed sides of a diaphragm. A first of the two chambers has no outlet, and the pressure of cold water therein presses against a first side of the diaphragm, while the second chamber includes an outlet to a further chamber having a heating element therein. The second chamber also includes a plunger, biased by a spring against a second side of diaphragm, and a plunger rod, which contacts an operating member of a microswitch. When a hot water handle of the faucet is opened, water travels from the further chamber to lower the cold water pressure in the second chamber and flex the resilient member toward the microswitch, to move the operating member and actuate the microswitch, so that the heating element is switched on. When the hot water handle is closed, the pressure in the two chambers will be equalized, and the spring will push the resilient member back to shut off the heating element.

The prior art teaches the use of high speed water heaters and a variety of safety devices for maintaining control thereof, but does not teach the subject combination of features especially the use of flow sensing override of temperature sensing and the use of ultrasonic flow sensing. The present invention fulfills these needs and provides further related advantages as described in the following summary.

SUMMARY OF THE INVENTION

The present invention teaches certain benefits in construction and use which give rise to the objectives described below.

The present invention is a water heater apparatus for aircraft applications where compact size, light weight and very fast water heating are priorities. The apparatus has three water heating tubes joined in series interconnection and which are positioned in side-by-side adjacency so as to be highly compact. Each of the tubes provides an electrical resistance heater which is part of a 3 phase electrical power circuit. Each tube also has a thermostat, and an electrical circuit breaker. The thermostats establish an open electrical circuit if water temperature exceeds a temperature set point. The circuit breakers establish an open circuit if electric current flow exceeds an electrical current set point. The apparatus uses a pressure check valve to prevent pressure in the water heating tubes from exceeding a water pressure set point. A temperature sensor is positioned for sensing water temperature at a water outlet and a water flow sensing switch identifies water flow in the water heating tubes.

A primary objective of the present invention is to provide an apparatus and method of use of such apparatus that provides advantages not taught by the prior art.

Another objective is to provide such an invention capable of heating water at a high rate.

A further objective is to provide such an invention capable of the maximum in safe operation.

A still further objective. is to provide such an invention capable of heating water within its heaters as soon as water flow is started so as to not fall into temperature deficit.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawing illustrates the present invention. In such drawing

DETAILED DESCRIPTION OF THE INVENTION

Figure 1:
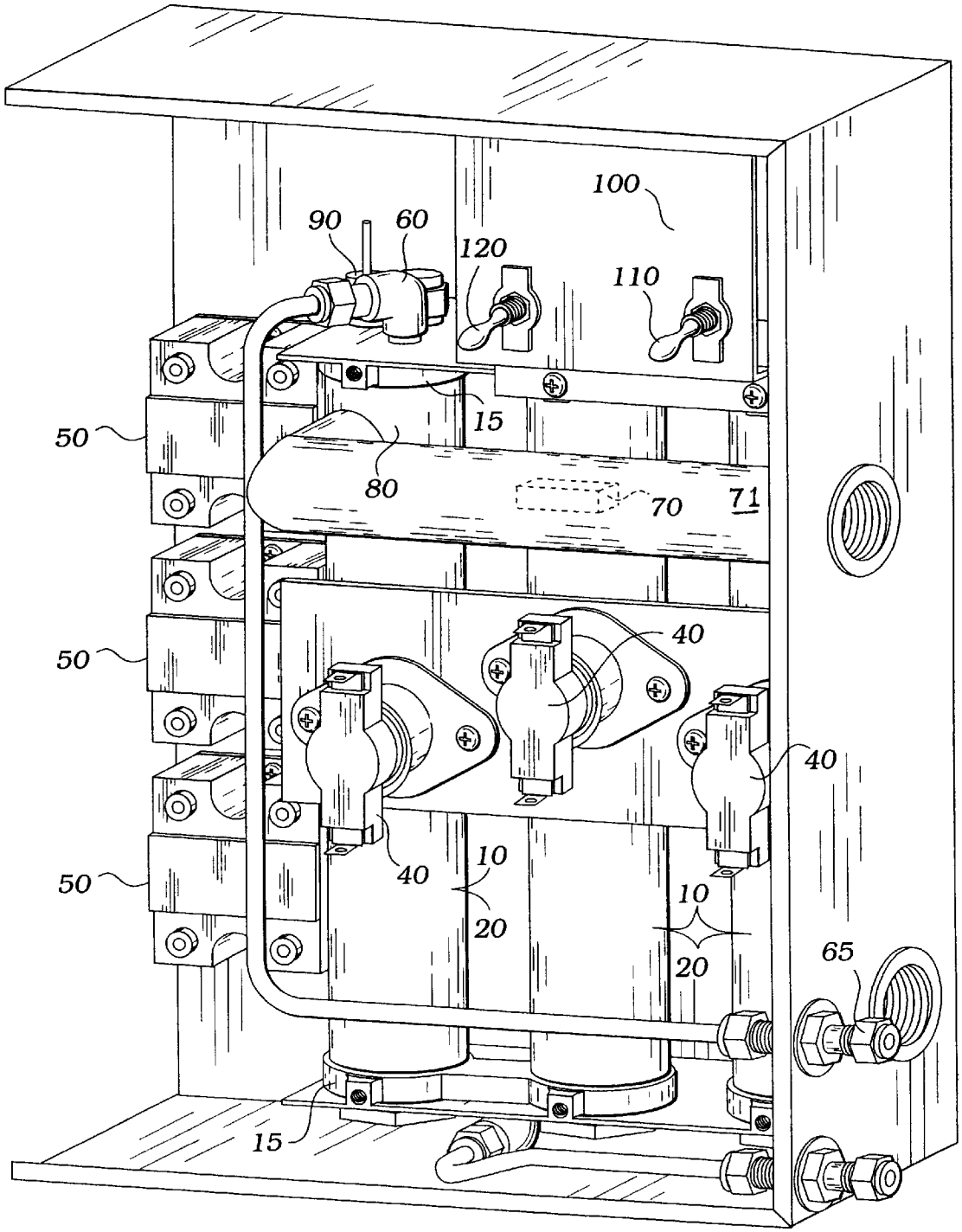
FIG. 1 is a perspective view of the preferred embodiment of the invention showing the several components which make up the apparatus. A chassis cover is not shown in this figure for improved visibility of the components of the invention.

The above described drawing figure illustrates the invention in at least one of its preferred embodiments, which is further defined in detail in the following description.

The present invention is a water heater apparatus for aircraft applications which comprises three water heating tubes 10 joined in series interconnection through connectors 15 and which are positioned in side-by-side adjacency providing a highly compact apparatus as is shown in FIG. 1. The water heating tubes 10 each provide an electrical resistance heater 20 contained within the tubes, comprising one leg of an electrical power circuit (Not shown). Each heating tube 10 also comprises a thermostat 40, and an electrical relay 50. Each of the thermostats 40 are adapted for establishing an electrical open in one leg of the power circuit if water temperature in that particular heating tube 10 exceeds a temperature set point. A three pole circuit breaker switch 120 is adapted for establishing an open circuit in the power circuit if electrical current flow in any one of the heaters 20 exceeds an electrical current set point. The apparatus further comprises a pressure check valve 60 adapted for expelling pressure from the water heating tubes 10, at outlet point 65, if pressure within the water heating tubes 10 exceeds a water pressure set point. A temperature sensor 90 is adapted and positioned for sensing water temperature at a water outlet position 80 of the water heating tubes 10. Finally, a water flow sensing switch 70, positioned within the outlet tube 71, is adapted for sensing water flow in the water heating tubes 10. In a preferred embodiment water flow sensing switch 70 further provides a sonar circuit wherein an ultrasonic wave is emitted into any one of the three heating tubes 10 and the wave is also sensed at the same point using methods well known in sonar technique. At the time that each sonic ping is emitted, a sensing circuit is turned off so that the transducer is not overloaded. After a waiting time, the sensing circuit is turned on to listen for an echo. When water is not s flowing through the heating tubes 10, echo response is measurably distinct from echo response when water is flowing. This distinction is related to the Doppler effect. The advantage of using an ultrasonic water flow sensing device is that flow is sensed instantaneously when it starts, and this provides an advantage in early heater response. When water flow is sensed by water flow sensing switch 70, power is delivered to the power circuit even if temperature sensor 90 shows outlet water temperature to be within acceptable limits. This provides an important advantage over prior art water heaters; the ability to maintain consistent and adequate temperature in the water output from the apparatus. The method of the present invention includes the steps of providing the above described apparatus and enabling heater current flow when water flow is sensed at the outlet. This gives the apparatus the ability to provide adequate water temperature without falling into early temperature deficit when water flow starts. Clearly, the above described apparatus requires a controller 100, which in the present case is an industrial micro-controller which may be of any common type well known to industry. Controller 100 maintains the aforementioned set points and logic circuitry to enable operation as defined above. Toggle switch 110 enables and disables the controller 100. The interconnecting circuitry and logic program are considered to be within the skill of those in this field.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A method of heating water which comprises: providing a heater apparatus having three water heating tubes joined in series interconnection and positioned in side-by-side adjacency; the water heating tubes each providing an electrical resistance heater comprising one leg of an electrical power circuit, a thermostat, and an electrical circuit breaker; each of the thermostats adapted for establishing an open circuit if water temperature exceeds a temperature set point, and each of the circuit breakers adapted for establishing an open circuit if electric current flow exceeds an electrical current set point; the apparatus further comprising a pressure check valve adapted for expelling pressure from the water heating tubes when pressure within the water heating tubes exceeds a water pressure set point; a temperature sensor adapted and positioned for sensing water temperature at a water outlet position of the water heating tubes; and a water flow sensing switch adapted for sensing water flow in the water heating tubes; and enabling electrical power in the electrical power circuit when water flow is sensed at the water outlet position.

* * * * *